United States Patent [19]

Sabo

[11] 4,157,857

[45] Jun. 12, 1979

[54] EDGE CONNECTOR FOR PRINTED CIRCUIT BOARDS

[75] Inventor: Julius A. Sabo, Colonia, N.J.

[73] Assignee: Western Electric Company, Inc., New York, N.Y.

[21] Appl. No.: 816,822

[22] Filed: Jul. 18, 1977

[51] Int. Cl.[2] ..... H01R 13/50

[52] U.S. Cl. ..... 339/176 MP; 339/17 R; 339/18 B

[58] Field of Search ..... 339/176 MP, 18 B, 17 C, 339/17 CF

[56] References Cited

U.S. PATENT DOCUMENTS

| | | | |
|---|---|---|---|
| 3,848,223 | 11/1974 | Pechard | 339/176 MP |
| 3,861,775 | 1/1975 | Makins | 339/176 MP X |

*Primary Examiner*—Roy Lake
*Assistant Examiner*—DeWalden W. Jones
*Attorney, Agent, or Firm*—W. O. Schellin

[57] ABSTRACT

An edge connector for a printed circuit board includes a housing having a central passageway for guiding the board. Contact elements are rotatably mounted in cavities of the housing adjacent to the passageway. Cantilever spring-type conductive terminals resiliently urge the contact elements so that they partially extend into the passageway. In their normal position (that is, without a board inserted into the passageway) the contact elements are in interfering relationship with the path of the board. Upon insertion of a board the contact elements resiliently yield to the board. Such contact elements selectively roll over the edges and any surface irregularities of the board to minimize the force required to fully insert the board into the passageway of the housing and to minimize the wear of the board. Such contact elements also provide both a good mechanical and electrical connection to contact areas of the board.

14 Claims, 8 Drawing Figures

EDGE CONNECTOR FOR PRINTED CIRCUIT BOARDS

BACKGROUND OF THE INVENTION

1. Field of the Invention

This invention relates to electrical connectors such as, for instance, edge connectors for printed circuit boards. In particular, the invention relates to those connectors which are subjected to repeated insertions and extractions of mating connector elements.

2. Description of the Prior Art

Desirable characteristics of electrical connectors include a firm electrical contact between contact elements of the connector and mating contact elements. Printed circuit board edge connectors usually have a large number of contact elements. These elements are simultaneously connected to a corresponding number of contact elements on a circuit board. Often a firm contact force between these elements makes it necessary to apply a relatively large force to insert the circuit board into the connector. Also, there is wear on contact surfaces when the contact elements come together in a sliding motion during the insertion of the printed circuit board into the connector.

In a prior art connector, forces required to insert a circuit board into a connector are reduced by engaging a camming member in the connector housing with the contact elements in the connector. The camming member moves the contact elements out of the way of the board before it is inserted into the connector. After the board has been inserted, the camming member is disengaged from the contact elements. The contact elements are thereby released and make contact with mating contact elements on the board. A relatively small insertion force is required to insert a circuit board into this type of connector. However, the described additional camming operation becomes necessary.

Other connectors use camming members which are operated by the action of the board itself as it is inserted into one of the connectors.

For example, one connector of the prior art has closely spaced camming surfaces located across one another at the opening through which the circuit board is inserted into the connector housing. When the board is inserted into the housing, the camming surfaces ride up on both sides of the circuit board. The thickness of the circuit board spreads the camming members apart. The camming members resiliently spread the housing as well as contact elements located in the housing. Upon full insertion of the circuit board into the housing the camming members become aligned with apertures in the circuit board. The camming members then recede into the apertures to take up their normal, uncammed position; and the contact elements in the housing engage contact surfaces on the board.

Another prior art connector uses a rocker cam to urge initially spaced contacts located in the connector housing into lateral engagement with an inserted circuit board. The cam is activated by the full insertion of the circuit board into the housing. As the circuit board is inserted it spreads closely spaced opposite cam members. These cam members rock or pivot to urge the contacts into lateral engagement with the circuit board.

The latter two connectors reduce wear on electrical contact surfaces by minimizing or eliminating contact engagement forces while the circuit is either inserted into or removed from the connector. The contacts of the connector do not engage the contact surfaces on the circuit board until after the circuit board is almost completely inserted into the connector.

Except when connector contacts are cammed out of the way of a circuit board by a separate operation, the force required to insert the board into its connector is usually related to the magnitude of the engagement force between mating contact surfaces. For circuits where circuit boards or cards are frequently inserted or removed, it is desirable to minimize the force requirements to insert or remove the boards without adding additional camming operations.

SUMMARY OF THE INVENTION

The present invention contemplates a connector that includes a housing which has a passageway to receive a connecting element having at least one contact surface. A contact element having a curved contact surface is rotatably supported within the housing and resiliently urged toward the passageway. Such element engages the connecting element and the contact surface of the connecting element. The engagement is accomplished with a selective rolling motion to overcome surface irregularities of the connecting element.

BRIEF DESCRIPTION OF THE DRAWING

Advantages and features of the invention will be best understood from the following detailed description when read in conjunction with the accompanying drawing wherein.

DETAILED DESCRIPTION

Figure 1:
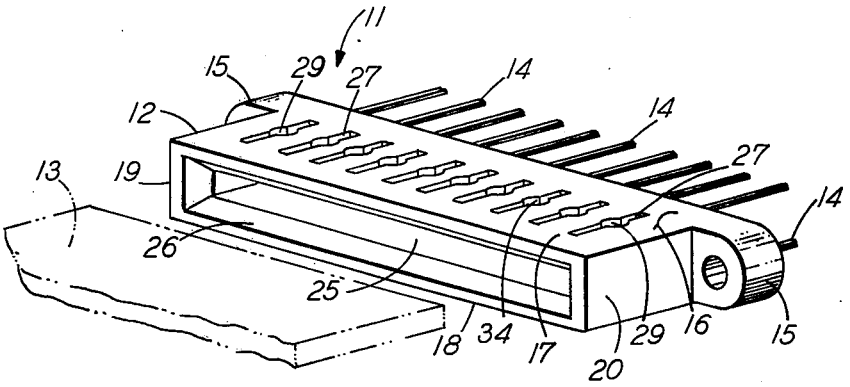
FIG. 1 is a pictorial view of a connector which includes the present invention.

FIG. 1 is a pictorial drawing of a printed circuit board edge connector which is designated generally by the numeral 11. The main body of the connector 11 is a housing 12 formed of an insulating material such as thermosetting plastic. A connecting element such as the circuit board 13 can be inserted into the housing 12.

Conductors of an electric circuit (not shown) are usually attached to terminals 14 extending from the housing 12. When the board 13 is inserted into the connector 11, it becomes coupled to the circuit. The connector 11 can be mounted to a support by two apertured lugs 15 which are located at opposite ends of the housing 12.

The extending terminals 14 are anchored in a base 16 of the housing 12. Besides the base 16, the housing 12 includes major walls 17 and 18 and end walls 19 and 20. These walls are pairwise spaced from each other to form a passageway 25 for the board 13. To aid the insertion of the board 13, the passageway 25 has a chamfered opening 26. From the opening 26 the passageway 25 extends parallel to the walls toward the base 16 to support the board 13.

Figure 2:
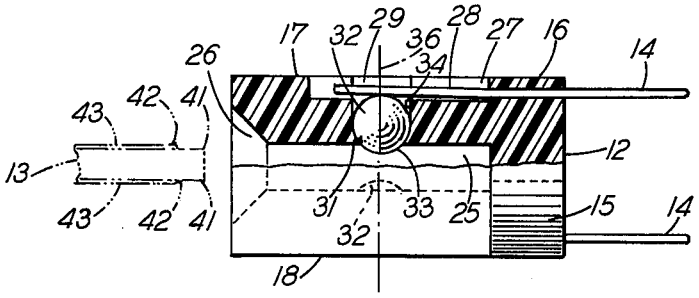
FIG. 2 is a partial section through the connector of FIG. 1.

Distinguishing features of the housing 12 over those of known connectors become apparent in reference to FIG. 2. The terminals 14 are anchored in the base 16. From the base 16 they extend to one side outwardly from the connector to be wired into any given circuit.

But from the base 16, the terminals 14 also extend in grooves 27 within the housing 12 as cantilevered members 28 substantially parallel to the passageway 25. Each of the grooves 27 intersects a well or cylindrical cavity 29 which extends perpendicularly through the respective wall 17 or 18 toward the passageway 25.

The terminals 14 are preferably formed of one of the known conductive alloys that are conventionally used for contact springs in circuit board edge connectors. In the connector 11, the terminals 14 are of square cross section and approximately 0.025 inch on each side. The material is a hardened beryllium copper which does exhibit a desirable resiliency.

The cavity 29 decreases in diameter adjacent the passageway 25 to form an annular seat 31 for a spherical contact element or ball 32. An opening of the cavity 29 to the passageway 25 permits a portion 33 of the ball 32 to protrude from the cavity 29 into the passageway 25. The ball 32 is guided along the cavity 29 by a cylindrical wall 34 of the cavity. The diameter of the cylindrical part of the cavity 29 is chosen to provide a small clearance between the wall 34 and the ball 32 to hold the ball 32 loosely and substantially centered on an axis 36 of the cavity 29, without any binding interference from the wall 34.

The movement of the ball 32 along this axis 36, however, is restricted at one end of the cavity 29 by the seat 31. At the opposite end of the cavity 29, the cantilevered member 28 extends from the base 16 across the cavity 29 to retain the ball 32. The member 28 also contacts the ball 32 and resiliently urges it against the seat 31 so that the portion 33 protrudes into the passageway 25. This protruding portion 33 also extends into the path of the board 13 when it is inserted through the passageway 25 into the housing 12.

As the board 13 moves along the passageway 25, leading edges 41 of of the board 13 engage the protruding protions 33 of all the balls 32 in the connector 11 and push the balls 32 out of the board's path. The balls 32 retract into the cavities 29 against the urging forces of the members 28. Since it is the board which pushes the balls 32 out of its path and into the respective cavities 29, the force required to fully insert the board into the connector housing is increased by the force required to push the balls 32 into the cavities 29. This insertion force becomes greater yet when friction further impedes the retraction of the balls 32 into the cavities 29.

However, friction forces on the balls 32 are minimized by supporting the balls 32 within their cavities 29 to permit them to rotate as well as to slide within their respective cavities. Consequently, when the board 13 is inserted into the housing 12 and first comes into contact with the balls 32, the balls tend to roll across surface irregularities on the board 13. The rolling motion reduces friction between the board 13 and the balls 32. Because of the reduced friction, the force required to insert the board 13 into the housing 12 is also lowered.

The surface irregularities which may cause the balls 32 to roll over the surface of the board 13 are primarily the leading edges 41, and edges 42 of a conductive circuit 43 on the board 13. However, a mere spot of surface roughness on the conductive circuit may cause one of the balls 32 to start rolling across such spot as the board 13 is inserted into the housing 12. On the other hand, the balls 32 are permitted to slide, when the sliding friction between the balls 32 and the board 13 is less than friction forces between the balls 32 and the housing 12.

Figure 3:
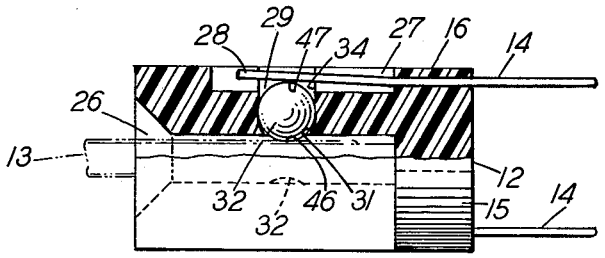
FIG. 3 shows the section of FIG. 2 with a connecting element inserted.

In FIG. 3 the circuit board 13 has pushed the balls 32 out of its path. The balls 32 are substantially retracted into the cavities 29. The balls 32 have consequently become dislodged from their seats 31 and rest firmly against respective contact elements or pads 46 of the circuit 43, each ball 32 being urged toward the board by the spring force of its respective member 28. Electrical contact between the circuit 43 and one of the terminals 14 is established through the ball 32 as an interposed element. The presence of such interposed element increases the number of surface-to-surface contacts by one in each of the conductor connections made by the connector 11.

Since additional surface-to-surface contacts in any circuit connections tend to increase resistances in the respective circuits, the present connector may not be ideally suited for circuits in which connector resistance values are critical and have to be minimized. However, in other circuits with respect to which such criticalities do not exist, the described connector offers advantages which may outweigh the presence of an additional contact resistance.

For instance, the possibility of rolling motion by balls 32 tends to eliminate high friction points. As a result the board 13 may be inserted smoothly into the connector 11. Also, the rolling motiion avoids abrasive interferences, or wear, between the engaging surfaces. Such interferences tend to damage the balls 32 or the circuits 43 on the board 13 or both. The possibility of damage to the balls 32 or the board 13 is increased when the board 13 has to be removed from, and reinserted into, the connector 11 more frequently.

Friction forces in the housing 12 which resist the rolling motion of the balls 32 during the insertion of the board 13 into the connector are minimized by preparing contacting sliding surfaces in the connector 11 with a smooth finish. For instance, a surface 47 of each member 28 which establishes contact with the ball 32 is preferably finished with a hard gold plate or a welded gold contact to minimize its coefficient of sliding friction with respect to the ball 32. The gold surface 47 and a gold plate on the ball 32 also minimize the electrical resistance between the member 28 and the ball 32. The coefficient of sliding friction between the ball 32 and the cavity wall 34 is also minimized by providing a smooth finish on the wall 34 and also a smoothly finished surface on the ball 32 itself.

Figure 4:
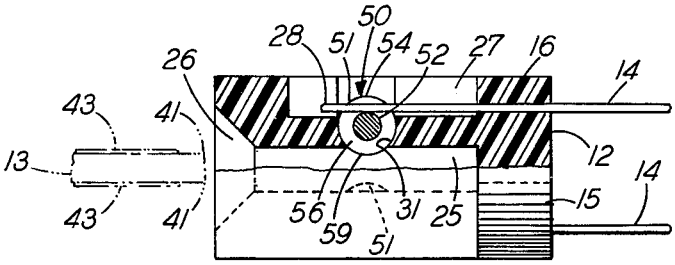
FIG. 4 is a partial sectional view of a connector showing an alternate embodiment of the invention.
Figure 5:
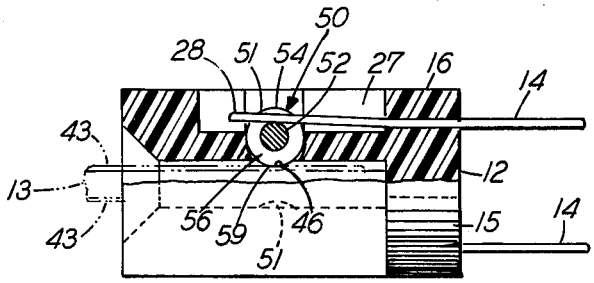
FIG. 5 shows the connector of FIG. 4 with a circuit board inserted.
Figure 6:
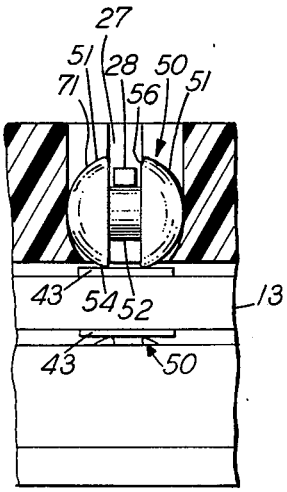
FIG. 6 shows a section through a contact well of the connector in FIG. 5.

FIGS. 4, 5, and 6 show connector contacts 50 which are different in shape from that of the balls 32. In describing this alternate embodiment, some connector elements with functions identical to those already described have been numbered with the same numerals as the previously described elements even though small differences in shape may exist because of design considerations.

FIG. 6 shows a partial view with an end view of one of the contacts 50. Each contact 50, insted of having the shape of one of the balls 32, consists of two parallel modified discs 51. The discs 51 are solidly interconnected by a necked-down portion or axle 52 to form an integral element. The peripheries 54 of each of the discs 51 are contact surfaces which interface with, or make contact with, the corresponding pad 46 on the circuit board 13. Inner, facing surfaces 56 of the discs 51 serve as lateral guide surfaces for the member 28. The member 28 rides in a recess 57 between the discs 51 and bears against the axle 52.

The surfaces 56 line up the contact 50 in the direction in which the member 28 extends. Unlike that of the ball 32, the orientation of the discs 51 in the housing 12 is important. The member 28 extends in the same direction in which the board 13 is inserted into the housing. The member 28 consequently insures a proper orientation for the discs 51 to permit them to engage the board in rolling contact.

In FIG. 4, the contact 50 rests against the seat 31 adjacent the passageway 25. The member 28 urges the contact 50 toward the passageway 25, and consequently against the seat 31. A portion 59 of the contact 50 protrudes past the seat 31 into the passageway 25. Thus, when the board 13 is inserted into the housing 12 the circular periphery 54 of the portion 59 engages the leading edge 41 of the board 13 in rolling contact.

The closeness of the member 28 to the center of rotation of the contact 50 helps the rotation of the contact 50 by producing very little resisting torque as a result of friction between the member 28 and the axle 52. Also, the closeness of the member 28 to the center of rotation results in a slower relative motion between the member 28 and the axle 52 than when the member 28 is in contact with the surface of the ball 32.

Another advantage of the contact 50 lies in its ability to make a good contact with the circuit board 13. Each of the two discs 51 of each contact 50 engage the mating pad 46 of the circuit board 13. The resulting redundance in the interface tends to reduce the contact resistance between the circuit board 13 and the connector 11. The urging force applied by the member 28 against the axis 52 is distributed substantially equally between the two discs 51 to result in an equalized contact pressure by the two interfacing surfaces.

Figure 7:
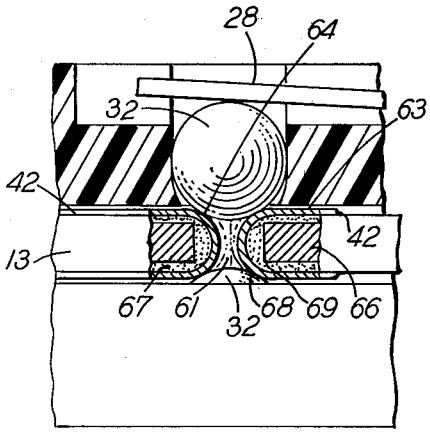
FIG. 7 shows a section through a contact well of the connector in FIG. 1, into which a special, apertured circuit board has been inserted.
Figure 8:
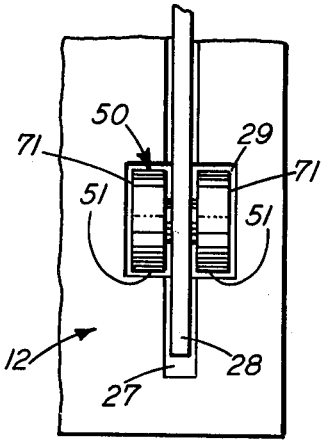
FIG. 8 shows a partial top view of the connector as in FIG. 4, but showing in greater detail an embodiment of a contact well having a rectanular cross section and a contact element having two discs.

FIG. 7 shows the ball 32 engaging a metallized aperture 61 in the circuit board 13. Such metallized apertures 61 may be used on the board 13 instead of the flat contact pads 46. As the board 13 is inserted into the housing 12, each ball 32 becomes aligned with and detents into one of the apertures 61. The ball 32 engages a conductive layer 63 located in and about the aperture 61 to make electrical contact therewith. At the same time the board 13 becomes lodged in this contact engaging position by the detenting action of the ball 32. Larger boards 13 have a longer inserted edge; and a correspondingly greater number of apertures 61 experience in combination a greater detenting action depending on the number of apertures and balls 32 involved.

Circuit boards 13 with the metallized apertures 61 instead of the flat contact surfaces 46 are ideally formed of what is commonly referred to in industry as "metal-core epoxy boards." Metal-core boards are typically made with rounded edges. The metal core boards 13 having the apertures appropriately spaced provide detents 64 as shown. Such a board has a metal base 66. A dielectric epoxy coating 67 covers the base 66 with rounded edges 68 covering otherwise sharp corners 69 of the base 66. And the circuits 42 are formed on the outer surface of the coating 67.

The coating 67 can be formed, for instance, by an electrostatic coating process or by a preferred fluidized bed coating process. In these processes the epoxy is applied either as a viscous liquid, or as a powder. The powder is liquefied before the epoxy is cured. After the epoxy is cured the conductive layer 63 may be deposited by any known deposition process, usually including an electroless deposition step.

Referring to both FIGS. 6 and 7, the contact 50 may be used in lieu of the ball 32 in conjunction with the apertured circuit board 13 of FIG. 7. However, because of the better contact, a line contact, between the ball 32 and the layer 63 (as compared with the spot contact of the ball 32 with the flat surface 43), for cost reasons the ball 32 may be preferred over the alternate contact 50 in this instance.

With respect to the cavity 29, a further advantageous modification is possible. The cavity 29 which retains the contact 50, or the ball 32, need not be of a circular cross section, as shown, for instance, in FIG. 1. The cavity 29 is easily formed with a circular cross section in low volume production methods. However, the housing 12 may also conveniently be molded with the cavity 29 having a square or rectangular cross section.

A square cross section of the cavity 29 accepts both the ball 32 and the contact 50 in FIG. 6. Frictional contact between the ball 32 or the contact 50 and the wall 34 can be reduced by choosing a square cross sectional shape over a circular shape for the cavity 29. The seat 31 is nevertheless formed to accommodate the spherical shape of the ball 32 or the shape of the contact 50.

A rectangular cross section of the cavity 29 is accompanied by a modification of outer surfaces 71 of the discs 51 from a spherical shape to a flat surface. Such a modification adapts the contact 50 to fit a slot of rectangular cross section, the width of which is slightly greater than the largest dimension across the two discs 51 of the contact 50. The length of the rectangular cross section exceeds the diameter of the discs 51 by a reasonable clearance to permit the contacts to freely rotate in the cavity 29.

It should also be noted that the circuit board 13 as used herein is a descriptive term for circuit boards and also for similar connecting elements. The term "board," is meant to include, for instance, laminated cards. These cards may, for example, include coded circuits which can be used for identification of items or persons associated therewith. It should now become apparent that for such identification purposes, frequent insertions and extractions of the board 13 become necessary. The disclosed embodiments are of particular interest when frequent insertions of connecting elements are contemplated.

The various embodiments have been described herein for illustrative purposes only and not to limit the present invention. It is apparent that other changes can be made without departing from the scope and spirit of the present invention. It is intended to limit the invention only by the scope of the appended claims.

What is claimed is:

1. A connector comprising:

a housing;

a passageway located in the housing for guiding a connecting element insertable in such passageway;

at least one contact rotatably mounted in the housing adjacent the passageway, the contact having a portion extending into the passageway and into the path of the connecting element to engage the connecting element with selective rolling motion across its surface; and at least one cantilevered contact spring anchored in the housing and extending past the contact for yieldably urging the contact into the passageway and against the connecting element upon insertion of the connecting element into the passageway and into engagement with at least one contact area on its surface, the contact spring also extending from the housing for connection to an external circuit.

2. A connector according to claim 1, wherein:

the housing includes at least one cavity extending through the housing perpendicular to the passageway, the cavity having a reduced cross section adjacent the passageway, the walls of the reduced section forming a seat; and the contact is of spherical shape loosely held within the space of the cavity, and restricted in its movement along the cavity by the seat and by the spring extending across the cavity opposite from the seat.

3. A connector according to claim 2, wherein:

at least one cavity comprises a plurality of cavities located at spaced intervals in a plane transverse to the direction in which the connecting element is inserted into the housing;

at least one contact comprises a plurality of contacts, each held in one of the cavities; and the urging means comprises a plurality of contact springs.

4. A connector according to claim 3, wherein the passageway has a rectangular cross section and the connecting element to be inserted therein is a printed circuit board.

5. A connector according to claim 4, wherein each contact area forms a metallized detent for each of the contacts in the connector, and the surface of each of the contacts makes at least line contact with the detent.

6. An edge connector for circuit boards, comprising:

a housing having a base, and walls extending from the base, the walls forming a passageway for guiding a circuit board insertable into the housing;

a plurality of conductive spring elements mounted in the base and having cantilevered first and second extensions in opposite directions from the base, the first extensions being directed away from the housing to form terminal pins connectable to an external circuit, the second extensions being located adjacent to and substantially parallel to the passageway; and a plurality of contact elements rotatably mounted in the walls interposed between the passageway and the second extensions, the second extensions resiliently bearing against the elements to urge them toward the passageway, to protrude into the passageway and into the path of the board, the contact elements engaging the board inserted into the housing with selective rotating motion.

7. A connector according to claim 6, wherein:

the walls include a plurality of spaced cavities extending substantially perpendicular to the direction in which the board is inserted into the housing, each of the cavities having a straight wall portion terminating in a seat formed by inwardly sloping wall portions adjacent to the passageway, each of the cavities holding one of the contact elements, the contact element being urged against the seat with a portion of the contact element protruding into the passageway.

8. A connector according to claim 7, wherein the contact elements are balls.

9. A connector according to claim 8, wherein the cavities have a circular cross section.

10. A connector according to claim 8, wherein the cavities have a square cross section.

11. A connector according to claim 7, wherein the contact elements comprise two parallel discs rigidly interconnected by an axle of a diameter smaller than that of the discs, and wherein the second extensions bear against the surfaces of the axles to urge the contact elements against the seats.

12. A connector according to claim 11, wherein the outwardly facing surfaces of the discs are spherical in shape.

13. A connector according to claim 11, wherein the outwardly facing surfaces of the discs are substantially flat.

14. A connector according to claim 13, wherein the cavities have a rectangular cross section.

* * * * *